United States Patent [19]

Vinh

[11] Patent Number: 4,613,132

[45] Date of Patent: Sep. 23, 1986

[54] LOOP PUZZLE

[76] Inventor: Kim L. Vinh, 3228 Harrisburg Pike, Landisville, Pa. 17538

[21] Appl. No.: 786,502

[22] Filed: Oct. 11, 1985

Related U.S. Application Data

[63] Continuation-in-part of Ser. No. 665,964, Oct. 30, 1984, abandoned.

[51] Int. Cl.[4] ..... A63F 9/08

[52] U.S. Cl. ..... 273/158

[58] Field of Search ..... 273/158

[56] References Cited

U.S. PATENT DOCUMENTS

| | | | |
|---|---|---|---|
| 478,668 | 7/1882 | Walker | 273/158 |
| 584,857 | 6/1897 | Dennis | 273/158 |
| 652,946 | 7/1900 | Wright | 273/158 |
| 2,481,108 | 9/1949 | Gore | 273/158 |
| 3,698,719 | 10/1972 | Winslow | 273/158 |

*Primary Examiner*—Anton O. Oechsle

[57] ABSTRACT

A puzzle of the type having an openable loop with two internal subloops in the form of two single turn coils spiraling continuously into each other through semi-oval non-flat curves, and a closed loop with two internal subloops in the form of two double turn coils spiraling continuously into each other through semi-oval flat curves. The two loops, when interengaged in accordance with a predetermined position, present the problem of their disengagement without opening the openable loop. For quick disengagement of the two loops in case of mistakes in the solution of the puzzle or for interengaging the two loops in the predetermined position, the openable loop is formed with a hook and an eye so that it may be opened and closed.

7 Claims, 6 Drawing Figures

LOOP PUZZLE

This application is a continuation-in-part of my copending application Ser. No. 665,964, filed Oct. 30, 1984, now abandoned.

The present invention relates to toys and specifically to a puzzle comprising two loops of wire which are wound in spiral forms, and which may be interengaged to present the problem of their disengagement as the solution of the puzzle.

A more specific object of the present invention resides in the provision of a toy which challenges its players' cleverness, patience and skills in removing a mechanical part from complicated obstacles.

Another object of the present invention resides in the provision of a small, light, safe, inexpensive toy which has a simple structure, yet which is an intriguing brainteaser.

The foregoing objects of the present invention will become more apparent during the following disclosure and by referring to the drawings, in which.

Figure 2:
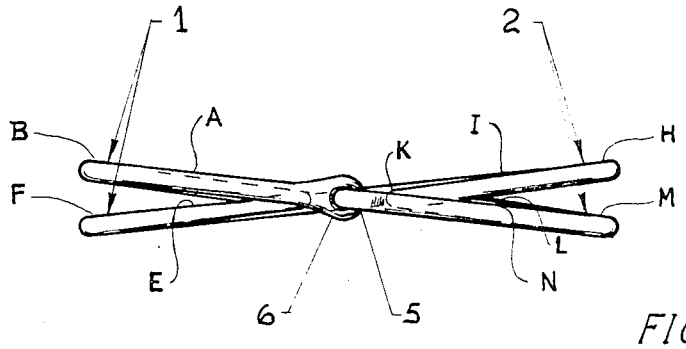
FIG. 2 is a side view of the openable loop.
Figure 3:
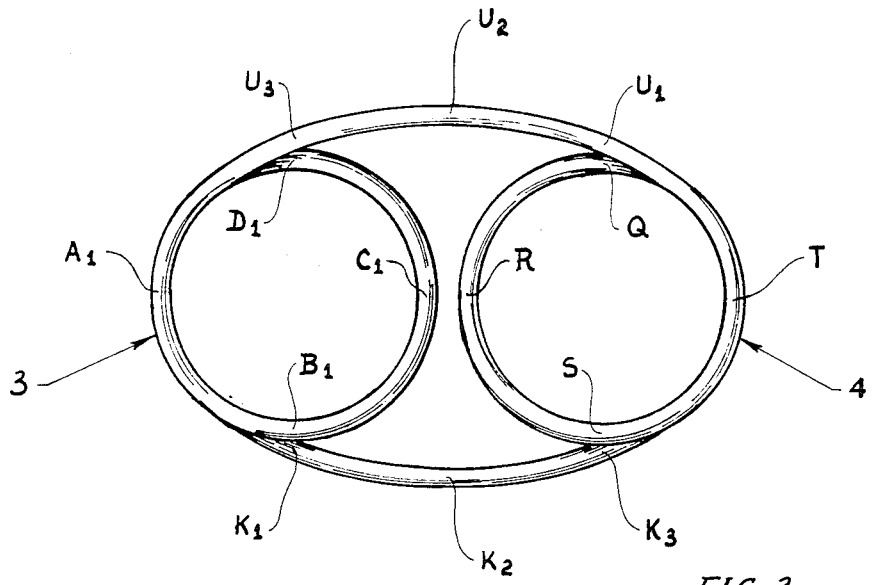
FIG. 3 is a top view of the closed loop.
Figure 4:
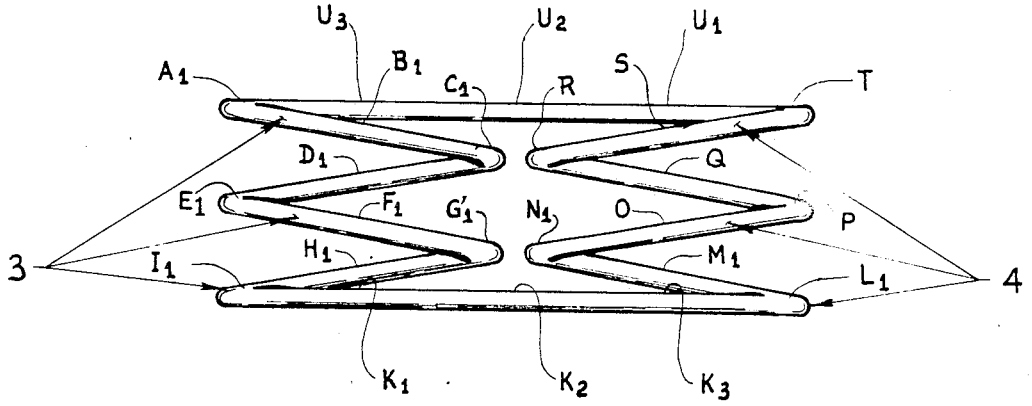
FIG. 4 is a side view of the closed loop.

The puzzle in accordance with the preferred embodiment comprises an openable loop of wire (FIGS. 1 & 2) with two internal subloops in the form of two single turn coils 1 & 2, and a closed loop of wire (FIGS. 3 & 4) with two internal subloops in the form of two double turn coils 3 & 4.

The openable loop, if viewed from the top (FIG. 1) has an oval outline and two internal circles. For clarity of description, the openable loop is supposed to start at point 6 or the eye (FIGS. 1 & 2); it makes a non-flat curve through A and meets point B; it then begins to spiral down gradually through C, D, E & F; now it makes a semi-oval non-flat curve through G1, G2 & G3 in order to meet point H; from there, it begins to spiral down gradually through I, K, L & M; it finally makes another non-flat curve through N and ends with a hook 5 which engages with the eye 6. The gap between B & F or between H & M is about twice the gauge of the wire. The gap between D & K is about four times the gauge of the wire.

The closed loop, if viewed from the top (FIG. 3), also has an oval outline and two internal circles. However, the diameters of these circles are greater than those of the circles in the openable loop by approximately three gauges of the wire. Thus, the double turn coils 3 & 4 provide adequate spaces in their circular openings so that the single turn coils 1 & 2 may move therein with little friction. For clarity of description, the closed loop is supposed to start at A1 in FIGS. 3 & 4; it gradually spirals down two turns through B1, C1, D1, E1, F1, G'1, H1 & I1; it then makes a semi-oval flat curve through K1, K2 & K3 and meets L1; from there, it gradually spirals up two turns through M1, N1, O, P, Q, R, S & T; it finally makes another semi-oval flat curve through U1, U2 & U3 in order to return to A1. The gap between A1 & E1 is about four times the gauge of the wire. The same holds true for the gaps between E1 & I1, L1 & P and P & T. The gap between C1 & R or G'1 & N1 is about the gauge of the wire.

Figure 1:
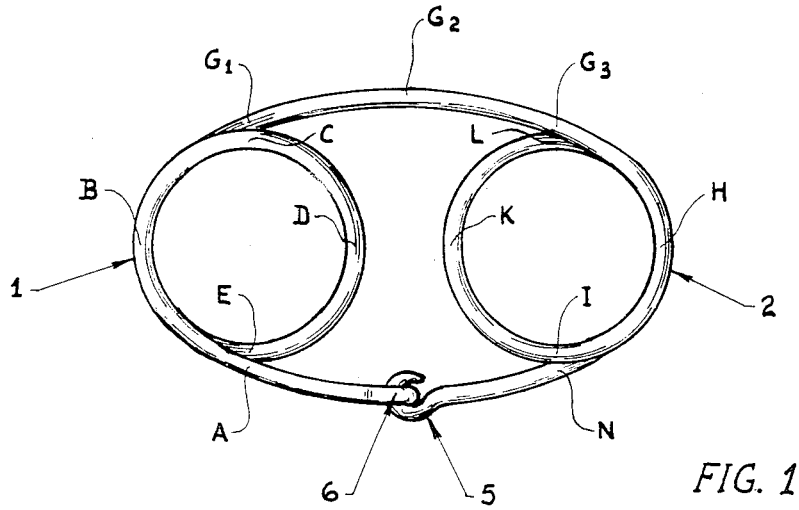
FIG. 1 is a top view of the openable loop.

The curves in the openable loop are termed "non-flat" because they are not parallel to the plane of the paper as viewed in FIG. 1. However, the curves in the closed loop are termed "flat" because they are parallel to the paper as viewed in FIG. 3.

Wire of the same gauge and flexibility is used to form the two loops. Spring is provided in the coils to reduce friction between the two loops in manipulations.

From the foregoing description, the two loops can be interengaged as follows:

Open the openable loop by disengaging the hook 5 from the eye 6. Insert two open arms (with A & N) of the openable loop into the two circular openings of coils 3 & 4. Close the openable loop by engaging the hook with the eye when each of the single turn coils is within each of the double turn coils (FIG. 5).

Figure 5:
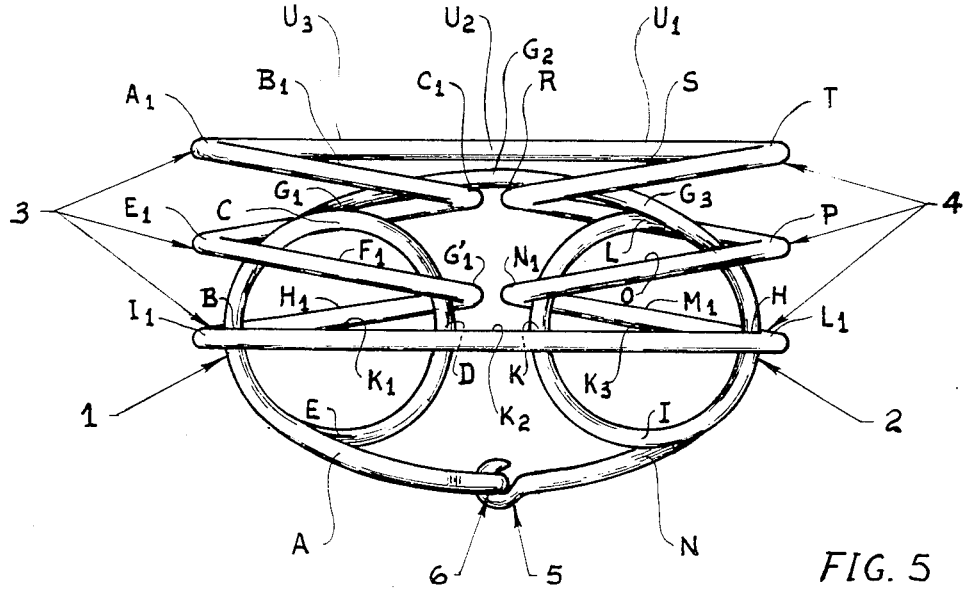
FIG. 5 is a view of the two loops interengaged in a predetermined position.

The problem of the puzzle is the disengagement of the two loops without opening the openable loop. The following is a method of solving the problem:

Refer to FIG. 5. Hold the openable loop vertically with your left hand and the closed loop horizontally with your right hand. Position the two loops as they are in FIG. 5. Raise the openable loop and pass the interengaged hook and eye over K2. In this position, A is on K1, N on K3, and I on O. With your left forefinger, raise E and slide it over K1. Free single turn coil 1 by pulling it toward you. Insert F1 between G1 and C. Swing the two loops so that single turn coil 2 is inside double turn coil 4. Pass P under M so that N slides over O, K over R, and T over H approximately. To free coil 2 from coil 4, pass T under H and M and slide coil 2 along U1, U2 & U3. Now by holding single turn coil 1 with your left hand and double turn coil 4 with your right hand, pull the two loops sidewise and in opposite directions while twisting the openable loop upside down. In this final position, note the following: (a) The hook and the eye are outward from you*. (b) All points (A, B, C, etc.) of the openable loop are upside down; however, the same letters and numerals are used to show points on other sides of these points. (c) Now only coil 2 still engages with coil 3. (d) B1 and F1 are between L and G3; U3 is on N. Bring coil 2 and coil 3 together so that M can slide under C1. Pull the two loops apart.

Figure 6:
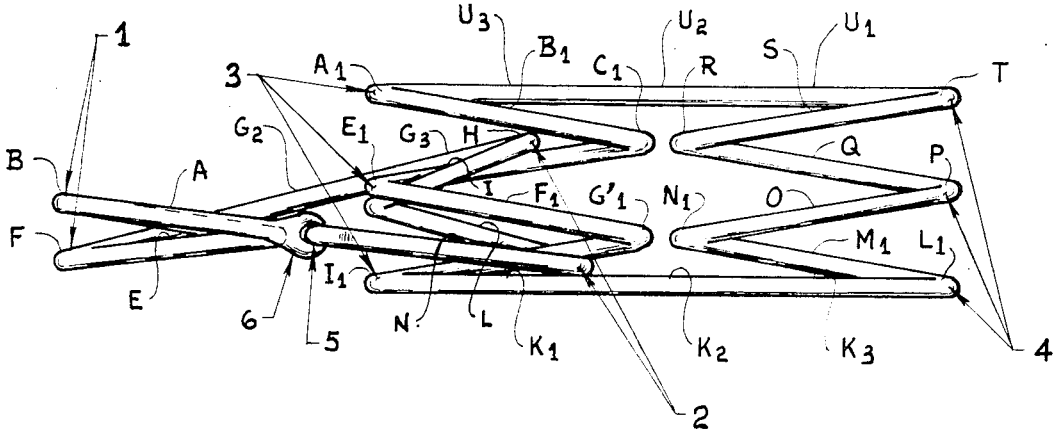
FIG. 6 is a side view of the two loops in the final interengaged position.

*FIG. 6 illustrates the final position with the hook and the eye inward to you.

While the preferred embodiment in accordance with the present invention has been illustrated and described, it is understood that various modifications may be possible, for example, the loops may be made of coated wire or plastic of different colors; materials of various gauges may be used to form the loops of different sizes. Accordingly, the scope of the invention should be determined not by the preferred embodiment, but by the appended claims and their legal equivalents.

I claim:

1. In a puzzle of the type described having an openable loop with two internal subloops in the form of single turn coils spiraling continuously into each other through semi-oval non-flat curves, and a closed loop with two internal subloops in the form of double turn coils spiraling continuously into each other through semi-oval flat curves, said openable loop being formed with a hook and an eye as means for putting said loops in a predetermined interengaged position and for quick disengagement of said loops independently of a solution of said puzzle, said predetermined interengaged position comprising each said single turn coil within a respective one of said double turn coils and the interengagement of said hook and eye so that disengagement of said loops can only be done by a series of prescribed manipulations.

2. The puzzle of claim 1 wherein said loops are made of material of the same gauge with relative flexibility to provide spring in said coils so that friction between said loops in manipulations may be reduced.

3. The puzzle of claim 1 wherein said closed loop is formed with a gap between two said double turn coils, said gap being approximately the gauge of the material used to form said loops.

4. The puzzle of claim 1 wherein said openable loop is formed with a gap between two said single turn coils, said gap being approximately four times the gap between two said double turn coils so that said single turn coils may be properly positioned within said double turn coils.

5. The puzzle of claim 1 wherein each said single turn coil has a gap between two outer curves in the spiral portion, said gap being twice the gauge of the material used to form said loops.

6. The puzzle of claim 1 wherein each said double turn coil is formed with a gap between any two turns, said gap being four times the gauge of the material used to form said loops.

7. The puzzle of claim 1 wherein said double turn coils are formed with adequate spaces in their circular openings so that said single turn coils may move therein with little friction.

* * * * *